United States Patent [19]

Russell

[11] Patent Number: 4,575,093

[45] Date of Patent: Mar. 11, 1986

[54] TRAVEL BOARD GAME

[76] Inventor: Ethel C. Russell, 202 Dodge Ave., Danville, Ill. 61832

[21] Appl. No.: 603,303

[22] Filed: Apr. 23, 1984

[51] Int. Cl.[4] ..... A63F 3/04

[52] U.S. Cl. ..... 273/244

[58] Field of Search ..... 273/243, 251, 252, 254, 273/283, 284, 287, 275, 244

[56] References Cited

U.S. PATENT DOCUMENTS

| | | | |
|---|---|---|---|
| 3,556,528 | 1/1971 | Spiring | 273/254 |
| 3,658,337 | 4/1972 | Peters et al. | 273/254 |
| 4,052,072 | 10/1977 | Beal | 273/254 |
| 4,061,336 | 12/1977 | Lincoln | 273/254 |
| 4,283,059 | 8/1981 | Beeder | 273/254 |
| 4,341,386 | 7/1982 | Kleva | 273/239 |

FOREIGN PATENT DOCUMENTS

| | | | |
|---|---|---|---|
| 8103622 | 12/1981 | PCT Int'l Appl. | 273/251 |
| 694880 | 7/1953 | United Kingdom | 273/248 |

*Primary Examiner*—Richard C. Pinkham
*Assistant Examiner*—Matthew L. Schneider

[57] ABSTRACT

A camping travel board game with plurality of camping modes of travel incorporated in the board game. Players have the opportunity to choose a set of contiguous "State Cards" they wish to travel through. The chosen set of "State Cards" is to be placed on the board surface. A plurality of "State Cards" gives players a plurality of playing surface possibilities on the board. The "State Cards" have indicia thereon stating various travel attractions offered only in the state it represents, making each "State Card" uniquely different. The board game has a stack of "Nuisance Cards" and "Pleasure Cards" (pertinent to camping) to hinder or help players win the game with the most points. The board game helps players to learn contiguous states, state attractions within each state, advantages and disadvantages of different modes of travel camping, nuisances and pleasures of camping vacations, as well as provide entertainment and family togetherness.

3 Claims, 9 Drawing Figures

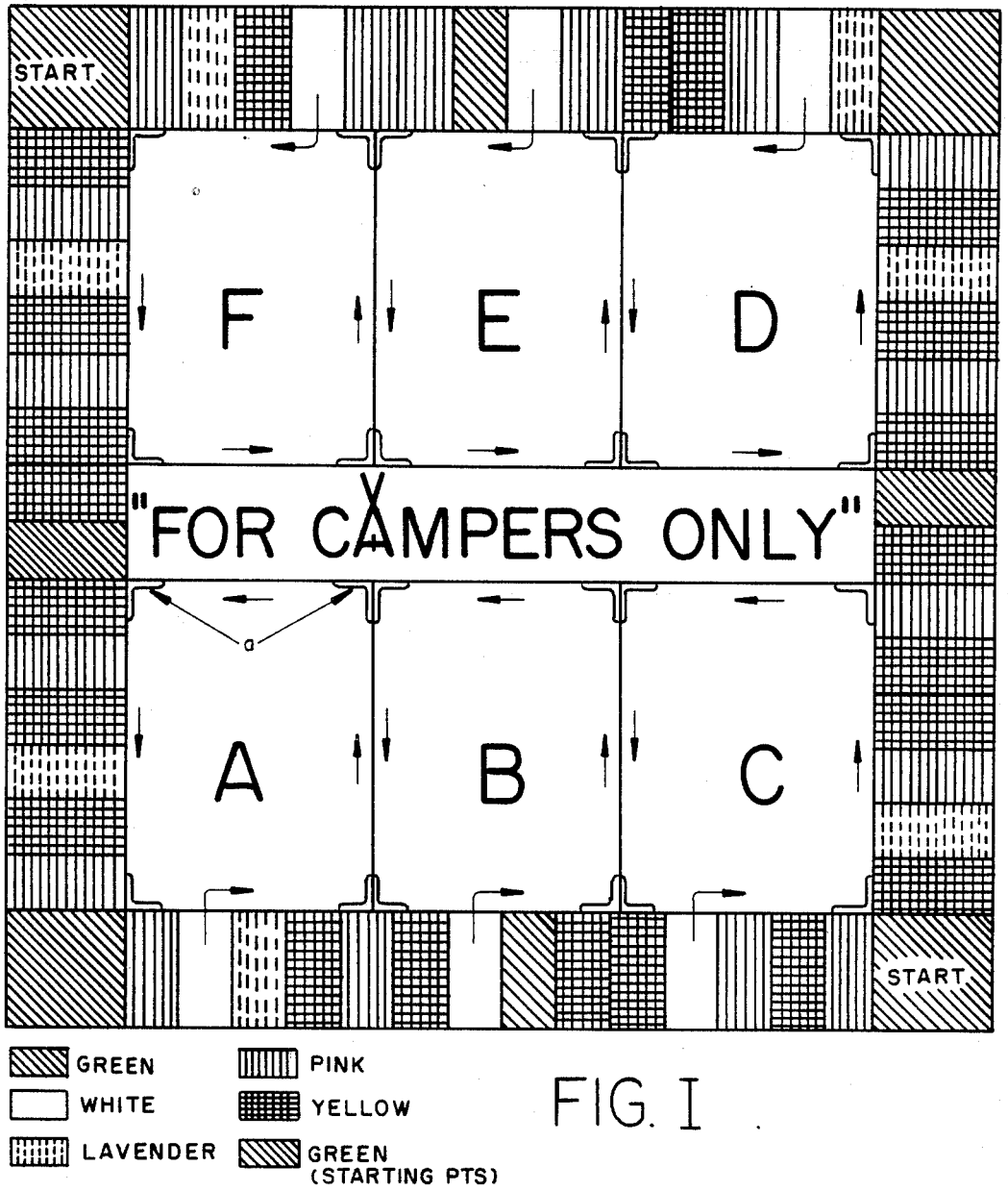
FIG. I
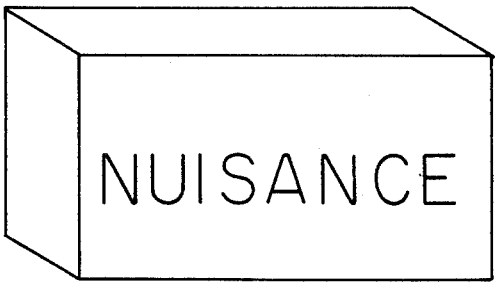
FIG. II
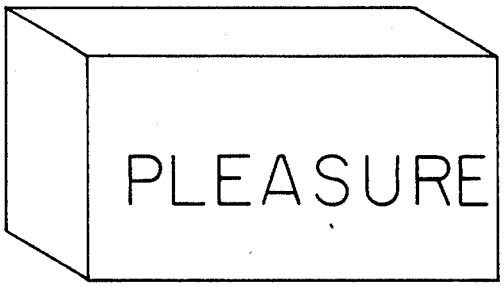
FIG. III

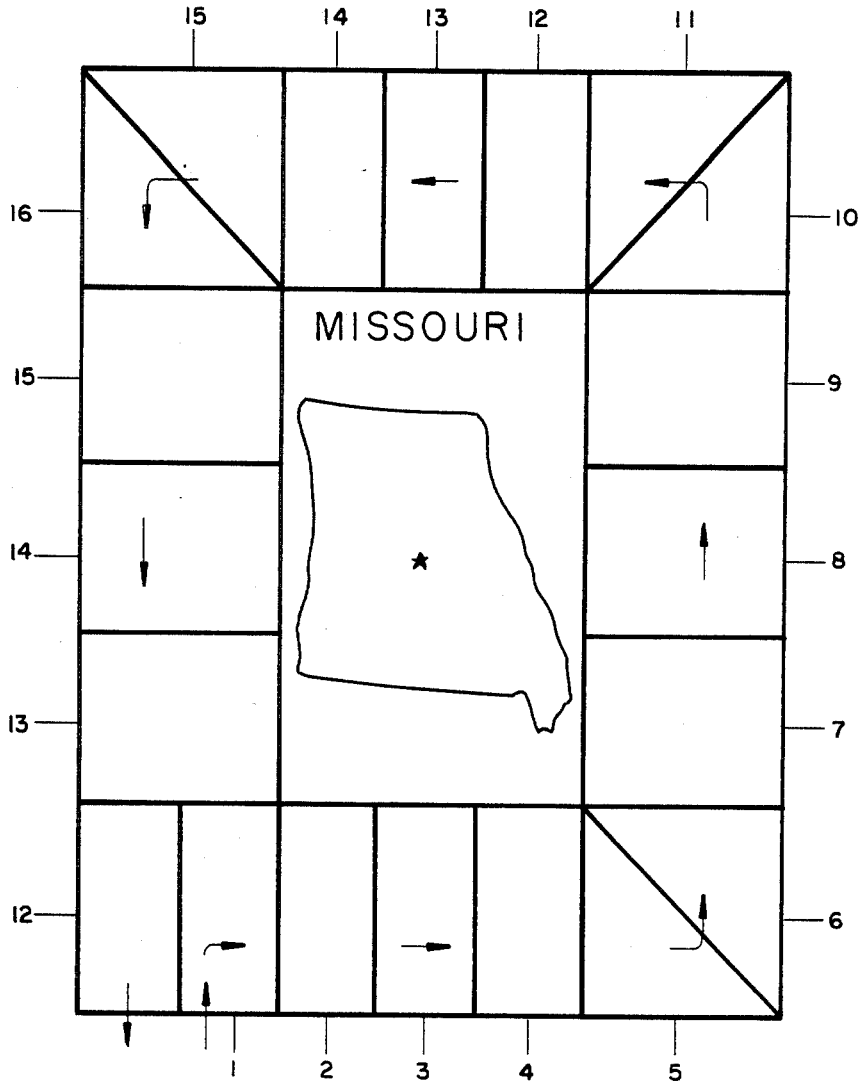
FIG. IV
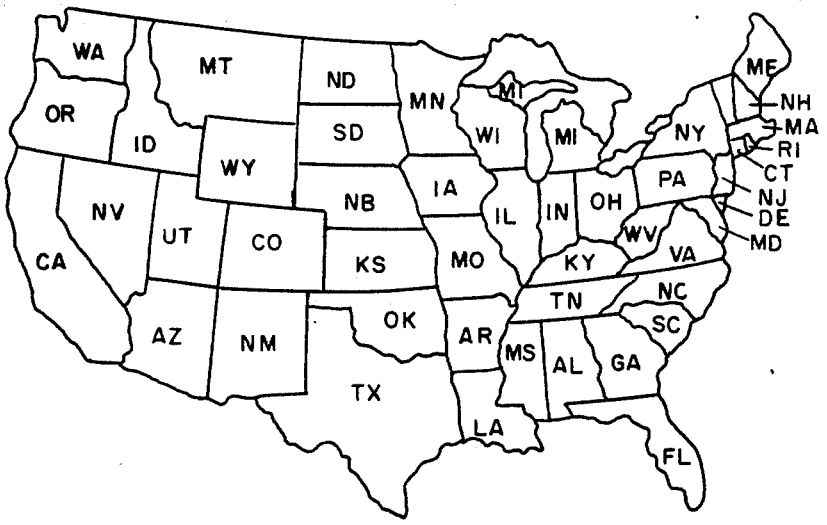
FIG. V

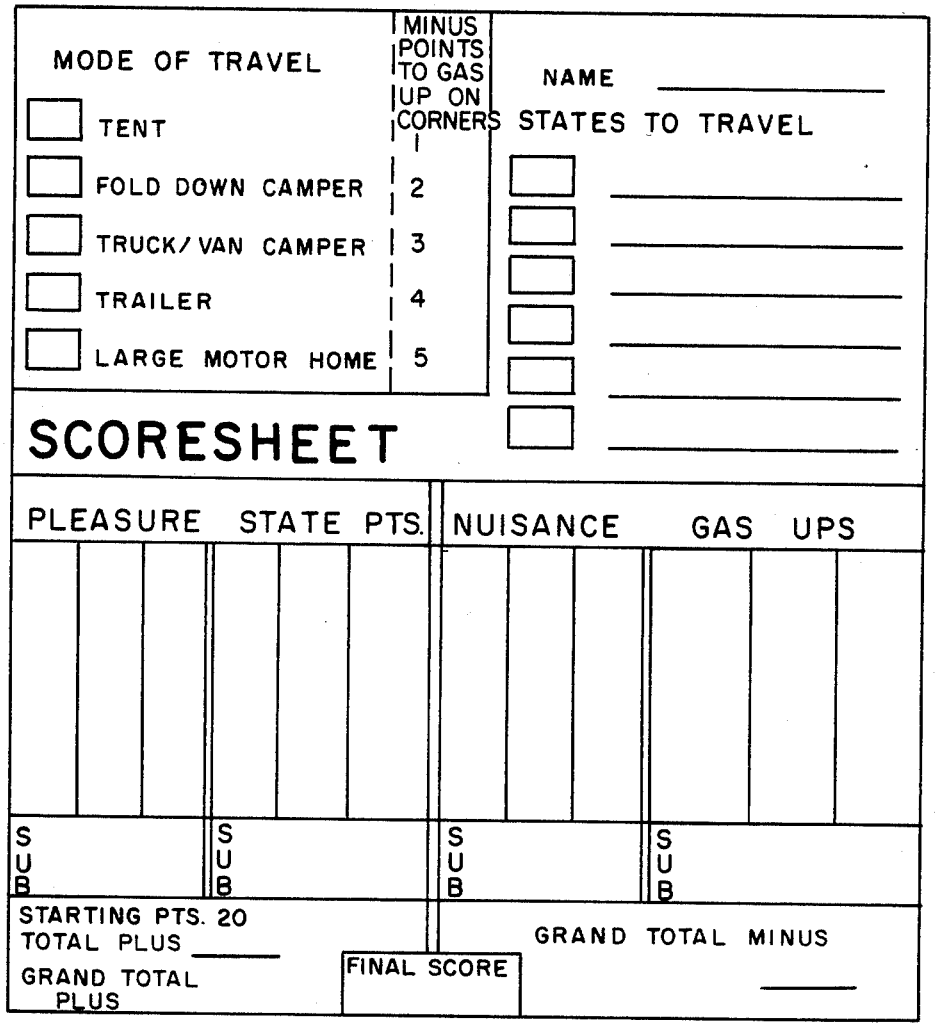
FIG. VI
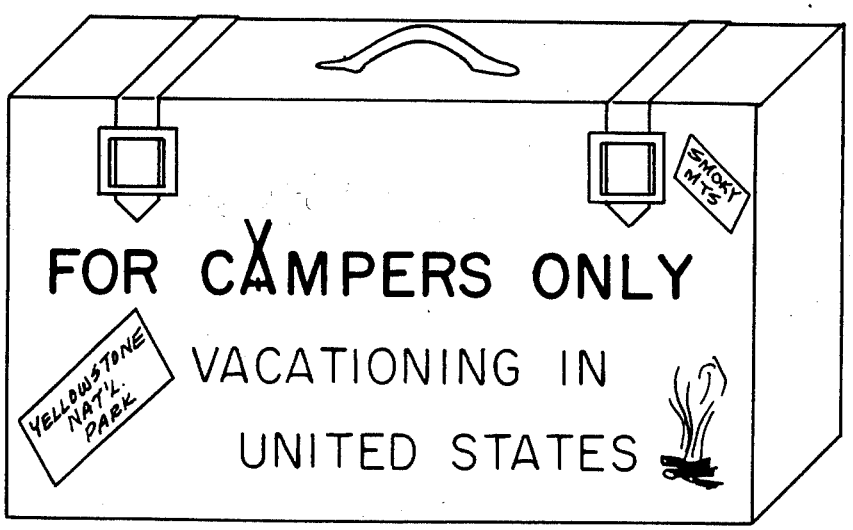
FIG. VIII
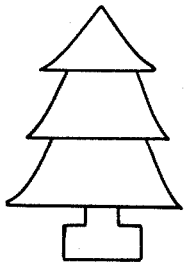
FIG. VII
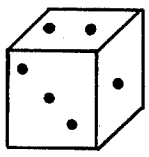
FIG. IX

TRAVEL BOARD GAME

BACKGROUND OF INVENTION AND OBJECT OF THE INVENTION

After many years of traveling and camping with our family via many types of automobiles and camping equipment, I wondered why there hasn't been a game that incorporated the fun places one visits in each state and the various pleasures derived in such traveling.

It's a well known fact that family units are breaking up in our society at an unheard of pace. Families that plan and work toward a common goal seem to survive. Also, when families learn more of our heritage, ties will become stronger. This travel game was designed to bring families to a new appreciation of our country and the work that went into making it great, by learning more about each state.

Since many young people have a hard time identifying the locality of a given state, I felt that a game that children could have fun playing while learning contiguous states should be designed. Also, the same game teaches the many nuisances and (or) pleasures of one mode of travel over another. The said travel game helps players evaluate each mode of travel before one might invest in a particular type of vehicle.

The said travel game is simple enough so smaller children could play and yet interesting enough to hold the interest of adults. Adults can identify with much of the pleasures and nuisances. The said game points out many attractions one might wish to visit in each state.

The said travel game could go either way—"For Campers Only", for "For Travelers Only", by changing mode of travel to small car, inter-mediate, large car, van and motor home, instead of tent, fold-down camper, truck/van, trailer, large motor home. Nuisances and pleasures would pertain to campers or travelers depending on mode of travel. My invention, as described in the specifications, refers to "For Campers Only", but game and game rules are basically the same and adaptable for either.

STATEMENT OF PRIOR ART

U.S. Pat. No. 4,061,336 by Launa J. Lincoln (December 1977)

U.S. Pat. No. 3,460,836 by Milton Schwartz (August 1969)

U.S. Pat. No. 3,467,387 by R. C. Schmitt (September 1969)

Travel games have been designed with different purposes and objectives in mind, but to my knowledge I haven't seen or been made aware of any that is like my invention of a game. My invention makes players aware of the various pros and cons (Nuisances and Pleasures) over one mode of travel versus another, leaving the players aware of advantages and disadvantages of each. To my knowledge I haven't seen any game that mentions camping and campers as a means of travel. My invention has emphasis on various attractions within the state.

I am aware of the above patents and believe my invention to be different. The difference are that I point out various attractions within each state, nuisances and pleasures. The U.S. Pat. No. 4,061,336 has simulated money involved, different types of travel than I have in my invention. It has train, hitch-hiking, plane, bus, etc.

Also, this U.S. Pat. No. 4,061,336 is a puzzle game completely different than mine.

SUMMARY OF INVENTION

A travel board game with plurality of camping (but not limited to) modes of travel incorporated in said board game. Players have opportunity to choose a set of contiguous "State Cards" they wish to travel through. The chosen set of said "State Cards" to be placed on said board surface. A plurality of said "State Cards" gives players a plurality of playing surface possibilities on said board. Said "State Cards" has plurality of indicia thereon stating plurality of travel attractions offered only in the state it represents, making each said "State Card" uniquely different. Said board game has "NUISANCE CARDS" and "PLEASURE CARDS" to hinder or help players win said game with the most points. Said board game provides means for players to learn contiguous states, state attractions within each state, advantages and disadvantages of different modes of travel, nuisances and pleasures of travel vacations, as well as provide entertainment and family togetherness.

BRIEF DESCRIPTION OF DRAWINGS

FIG. I—ONE PARLOR GAME BOARD;

FIG. II—REPRESENTS PLURALITY OF NUISANCE CARDS;

FIG. III—REPRESENT PLURALITY OF PLEASURE CARDS;

FIG. IV—PLURALITY OF STATE CARDS (TO BE PLACED ON GAME BOARD (FIG. I) TO MAKE PLURALITY OF SURFACE POSSIBILITIES;

FIG. V—MAP OF UNITED STATES FOR REFERENCE ONLY;

FIG. VI—SCORESHEET;

FIG. VII—REPRESENTS DESIGN OF PLAYING MARKER;

FIG. VIII—BOARD GAME CONTAINER;

FIG. IX—DIE (REPRESENTING A CHANCE NO. INDICATOR).

REFERRING NOW TO THE DRAWING REFERENCE

FIG. I

Designates one parlor game board. Model scale $\frac{3}{8}'' = 1$ inch (but not limited to). Before game is in progress, each player rolls the die (FIG. IX) to determine mode of travel camping each player uses during the entire game. They are as follows:

Roll said die numeral 1=Tent Camping
Roll said die numeral 2=Fold Down Camper
Roll said die numeral 3=Truck/Van Camper
Roll said die numeral 4=Trailer
Roll said die numeral 5=Large Motor Home
Roll said die numeral 6=Player may choose one of the above.

Two or more player play clockwise around the outside of said board (primary travel path) with Playing Marker (FIG. VII) marking location of each player, in accordance with throw of numerical said die. The primary travel path around said board being divided into a plurality of individual units are as follows:

1—(green units) GAS UPS—Players mark down on "scoresheet" (FIG. VI) when they land on said "GAS UP" unit and or pass "GAS UP" corners. Said "GAS UP" points are deducted before final score is determined.

2—(White units) ENTER STATES (A-F) at these units.

3—(Lavender units) LOSE A TURN when landing on this unit.

4—(Pink units) NUISANCE—Players take a "NUISANCE CARD" (FIG. II) when players land on this unit.

5—(Yellow unit)—PLEASURE—Players take on a "PLEASURE CARD" (FIG. III) when players land on one of these units.

6—STARTING POINTS—Each player has a choice of which corner of the two starting corners on which to place his playing Marker (FIG. VII) and start said game.

a—Plastic (but not limited to) ⅛" raised ridges on corners of said playing board to separate "State Cards" (FIG. IV) and provide means for purpose of immobility of said "State Cards", so said board surface is firm and playable.

A,B,C,D,E,F—Places reserved on said game board to place said "State Cards" (FIG. IV). Players play counter clockwise while playing on said "State Cards".

FIG. II

NUISANCE CARDS—A plurality of said "NUISANCE CARDS", each having indicia different. Said "NUISANCE CARDS" are for the purpose of hindering players from winning said game. Each said "NUISANCE CARD" indicia pertains to nuisances incurred while camping. Players pick up said "NUISANCE CARDS" when the numeral 5 appears on roll of die while playing on said "State Cards" (FIG. IV) and when players land on said pink units in (FIG. I,IV). Record Pts. on "Scoresheet" (FIG. VI). Sample set of said "NUISANCE CARDS" as follows: (pertains to camping but not limited to camping)

1. "It's raining very hard and you just stopped to put up your camper. −5 points"
2. "Your self contained unit needs emptying, but there is no dump station available. (Applies only to Trailer or Motor Home). −5 points.
3. "You just went to take a shower, to learn that it takes a quarter (which you do not have). You have to go back to the campsite to get it. −3 Points"
4. "The shower that called for a quarter—gave you a dimes worth of water and you have your head all soaped up to rinse off. −5 points"
5. "Oh my—what's wrong with the zipper to the tent? It won't zip. (applies only to tent and fold down campers) −3 points"
6. "What's that I smell? Could it be a skunk close to our campsite? −5 points"
7. "Oh my! We picked a poor one. PIT TOILETS! −4 points"
8. "WHOOPS—WHAT WAS THAT? FLAT TIRE! −5 points"
9. "Had a hard time in locating the campground. −1 point"
10. "Stayed out in the sun too long and acquired a terrible sunburn. −4 points"
11. "Went to the beach and the flag was out, you can't go out because of strong undertow. Applies only if you are traveling in a state close to the ocean or a huge body of water. −2 points"
12. "Detour in route. Lose a turn"
13. "Forgot the insect repellent and was eaten up with insects. −4 points"
14. "Bridge out in route to campground. −2 points"
15. "Have to take time out to do laundry. Lose a turn"
16. "Rained all evening after setting up camp, couldn't take advantage of all the outdoor activities at campground. −3 points"
17. "Whoops! The tent sprung a leak. If you have a hardtop or motor home, this doesn't apply to you. −4 points"
18. "One lane traffic through tunnel in the mountain. Lose a turn"
19. "Ready to take pictures of fantastic scenery but forgot to buy film for camera. −3 points"
20. "Stopped to swim, but swimsuit is in the folddown camper. Applies only to folddown campers. −3 points"
21. "Went to shower house to take shower and forgot the towel and soap. −2 points"
22. "Bad wind storm came up while sleeping! −4 points"
23. "Bad electrical storm came up. No damage. −4 point"
24. "I knew we should have fixed that hitch the last town we went through. Sorry, you *lose a turn* while somebody comes and fixes it. (Doesn't apply to truck or motor homes, tents)
25. "It sure is hot out and the car has a vapor lock. −4 pts
26. "Car is registering hot so you have to open windows, turn the heater on to, to cool car. Save the car but smothered your family. −4 points"
27. "Tent was placed in low spot and it rained during the night. You guessed it, there is a puddle of water on the tent floor. −3 points"
28. "Ready to cook on the gas stove but forgot to pack the matches. −2 points"
29. "Camped in high altitude and sleeping bags were too light weight to keep everyone warm. −5 points"
30. "Flat tire, took all things out of car trunk and a sudden cloud burst came up and everthing (including your walet is wet) −5 points."
31. "Forgot to get ice in town and ran out. (Ignore if you have motor home or trailer with electric refrigerator. −2 points"
32. "Ate soup for supper and crackers were soggy because they weren't packed in a tight container. −1 points"
33. "Could hardly eat for the bee hive close by. Bees were everywhere. −1 point"
34. "Your're ready to open a can of beans to fix supper. Didn't anybody remember to bring a can opener? −1 points
35. "Clothes in your closet in your motor home, travel trailer, truck camper fell down and was on the floor of the closet. Doesn't apply to tent or fold down campers. −2 points"
36. "Forgot to anchor dishes in trailer in route. They were all over everywhere when you stopped. −2 points"
37. "Car overheated while you were pulling your large trailer today. −3 points"
38. "Forgot to pack raingear and it rained all day. −3 pts"
39. "You are vacationing with friends and are suppose to follow them. You lost them in route. Didn't catch up with them until late that evening (lucky you knew where they were planning to stop that evening) −4 points"

40. "Somebody left their makeup kit in the back window of the car while traveling. Everything is melted. What a mess! −3 points"
41. "Your motor home or truck camper is all set up at the campsite and supper is cooking, when somebody wants to be driven someplace. −3 points"
42. "Detour road was freshly tarred. Tar got all over your camper and car. −4 points"
43. "Didn't find a shady spot for your campsite. It is a hot-hot day. −3 points"

More or less could be used and blank "NUISANCE CARDS" could be included for players to add their favorite experiences.

FIG. III

PLEASURE CARDS—a plurality of said "PLEASURE CARDS", each having indicia thereon different for the purpose of helping players learn the many pleasures of camping vacations and secondly, to help players gain points toward winning said game. Players pick up said "PLEASURE CARDS" when the numeral 6 appears on roll of die while playing on said "State Cards" (FIG. IV) and when players land on said yellow units in (FIG. I,V). Each said "PLEASURE CARD" represent pleasures derived while camping (but not limited only to camping). These points are recorded on said "Scoresheet" (FIG. VI). A sample set of said "PLEASURE CARDS" as follows:

1. "Your family had steak for supper with all the atmosphere of the great outdoors. 3 points"
2. "Your family had fried fresh Red Snapper from the fish market. The best ever! 5 points"
3. "You are able to attend the State Fair in the state you are traveling. 3 points"
4. "You came across a Historical Landmark and stopped to look at it and learned more about the state. 2 points"
5. "Everyone took a swim, while supper was cooking on the charcoals in a coffee can. Supper was great after the swim. 2 points"
6. "Ate the evening meal right on the beach! What Fun! 1 point"
7. "Played "For Camper's Only" game in the evening with the family at the campsite. 5 points"
8. "Gathered seashells on the beach. 1 point"
9. "Popped popcorn in the evening, while playing games. 1 point"
10. "Had a wiener roast with roasted marshmallows by the campfire. 2 points"
11. "Your air conditioner in your travel trailer or motor home feels good on this hot humid night. 5 points"
12. "Met new friends at campsite while setting around the campfire. 2 points"
13. "The children took some pony rides after supper. 2 points"
14. "There was playground equipment for the children to play on, at the campsite. 1 point"
15. "You caught enough fish for supper tonight. Tasted good. 3 points"
16. "There was a water slide at the campground that all could slide on. 4 points"
17. "Was able to take excellent pictures of family by the campground equipment. 2 points"
18. "You arrived at your campground early enough to get a choice campsite overlooking lake, and swimming pool. 5 points"
19. "You were able to take a swim before supper. 1 point"
20. "You were camping near the ocean and was able to swim in the ocean (applies only if the state you are traveling borders an ocean). 4 points"
21. "You were able to take in a nature trail in the park you camped at. 1 point"
22. "The family rented bicycles and you went for a ride. 2 points"
23. "You were able to go on a horseback ride in the park where you were camping. 3 points"
24. "You played tennis with fellow campers. Sorry you lost the game. 2 points"
25. "You played a game of tennis with fellow campers. You won the game! 3 points"
26. "You played a game of badminton. You managed to lose by just a few points. 2 points"
27. "You played a game of badminton. You managed to win after being behind most of the game. 3 points"
28. "The family rented a tandem bike for all to ride. 3 points"
29. "Hot whirlpool at the campsite. 5 points"
30. "Beautiful sunset for all to enjoy. 1 points"
31. "Weather was fantastic today. 5 points"
32. "Good buy at souvenir shop. 1 points"
33. "Trip today was on a super highway. 2 points"
34. "Eating breakfast today in the fresh morning air was just fabulous. 3 points"
35. "Everyone enjoyed the camp's hayride tonight. 4 points"
36. "The parks ranger's nature talk and slides were especially informative tonight. 4 points"
37. "Cooks night out, everybody ate out at a very nice restaurant. 5 points"
38. "Previous campers left firewood. It was a welcome sight on this cool night. 4 pounts"
39. "Took in a special at the nearby civic center. 2 points"
40. "The campfire songfest was enjoyable. 1 points"
41. "Your family today rented a canoe for a couple hours. 2 pts"
42. "Your campsite was close to old, old friends and they came out to join you for the evening. 5 points"
43. "Had a fun time on the paddleboats tonight. 2 points"

More or less could be used and blank "PLEASURE CARDS" could be included for players to add their favorite experiences.

FIG. IV

STATE CARDS—A plurality of "State Cards" with each said "State Card" having indicia pertaining to the State it represents whereby making *each playing surface on said "State Card" uniquely different.* Each said "State Card" has individual units thereon, having indicia stating plurality of vacation spot attractions offered in State it represents. Players gain points as they land said "Playing Maker" (FIG. VII) on said individual units. The plurality of said "State Card" provide means for players to choose a given set to be placed on said game board (FIG. I, A–F). Players are now able to use their "Playing Marker" (FIG. VII) throughout the said chosen "State Cards" and play the said camping (but not limited to) travel game. A sample set of six said "State Cards" as follows:

MISSOURI

1. "You are now entering the "Show me State". (Missouri) Have fun camping! 1 point"
2. "At Branson your family will enjoy *The Shepherd of the Hills Farm* and *Old Mill Theater* which dramatizes the Shepherd of the Hills. 4 points"
3. "A trip to Missouri would not be complete without probing into *Silver Dollar City's* many craft demonstrations at Branson. 4 Points"
4. "Your family has a yen for exploring today. At Camdenton's *Bridal Cave* will give them plenty to explore. 3 Points"
5. "Everyone wants to tour *Mark Twain's Boyhood Home and Museum* at Hannibal today. 3 points"
6. "Take a cruise down the Mississippi River today on *Mark Twain's Excursion Boat.* 1 Point"
7. "A history lesson will be your's today as you visit *Harry S. Truman Library and Museum.* 2 Points"
8. "You will wonder if you are in Europe as you drive down Kansas City's many Boulevards with statues and trees. 1 Point"
9. "At Kansas City your family *will* have worlds of fun as you visit *Worlds of Fun* with 5 theme areas. 4 Points"
10. "Your baseball enthusiasts will be happy as you take in Kansas City Royals ballgame today. 4 Points"
11. "Take your camera with you today as you drive through and camp in the scenic territory of *Mark Twain National Forest.* 5 Points"
12. "At St. Joseph your family will be enthralled in viewing the *Doll Museum.* 1 Point"
13. "Triple treat today as you travel to St. Louis and visit *Forrest Park,* and go to *McDonnell Planetarium, St. Louis Zoo,* and Jewel Box. 3×3 Points=9"
14. "Excitement is in store today as you go on top of the *Gateway Arch* in St. Louis. 2 Points"
15. "Your Botanist in the family (as well as everyone else) will be delighted as you go to *Missouri Botanical Gardens* (one of the world's largest). 4 Points"
16. "At St. Louis, *Six Flags over Mid-America* will furnish enjoyment for your family with many a ride today. 3 Points"
17. "A child's paradise is in store for everybody as you go to *Magic House* in St. Louis today. 2 Points"
18. "Water skiing is on the agenda today as you camp near one of the many reservoirs in the state. 5 Points"
19. "At Clarksville your family will take a skyride carrying you approximately 600 Feet above the Mississippi River. 4 pts"
20. "Come back again soon and camp in our great state! Drive carefully! 1 Point"

ILLINOIS SAID "STATE CARD"

1. "You are entering the Prairie State. (Illinois). 1 Point"
2. "Your look into the past for today is *Bishop Hill State Historic Site.* A hundred year old Swedish settlement. 3 Points"
3. "The children will all be delighted today as your excursion takes you to *Brookfield Zoo.* 4 Points"
4. "Your "culture" for the day is visiting the *Art Institute of Chicago.* 5 Points"
5. "Your budding astronomer will be delighted as the *Adler Planetarium* will be on the agenda today. 4 Points"
6. "Your history learning experience for today will be the *Field Museum of Natural History* and *Chicago Academy of Science.* 5 Points"
7. "A trip to Illinois isn't complete without seeing *Lincoln's Home* at Springfield. 5 Points"
8. "Your family will investigate the *Museum of Science and Industry of Chicago.* 4 Points"
9. "A playful day takes everybody to *Marriott's Great America* with 5 theme parks. (Gurnee) 3 Points"
10. "A jaunt to Dundee to the *Haeger Potteries* is on your itenerary today. See for yourself how pottery is made. 2 Points"
11. "A journey to Galena takes you to the annual *home tours* for a glimpse of period architecture. 3 Points"
12. "You will visit *Lincoln's Tomb* at Springfield today. 4 Points"
13. "Walk down *New Salem's Old town* and learn more of Lincoln's era around 1830–1837. 4 Points"
14. "SORRY—You are too early for the *Illinois State Fair.* −2 Points"
15. "Your getaway for today will be to the Illinois "Ozarks" at *Giant City State Park* near Carbondale. 3 Points"
16. "Everybody will have a relaxing day boating and swimming at *Lake Carlyle.* 4 Points"
17. "Watch out for horse and carriages on the highway near Arcola as you drive to *Rockhome Gardens* and visit the Amish community. 3 Points"
18. "Visit magnificant *Krannert Center of Performing Arts* with 5 theaters today. 4 Points"
19. "SORRY—NO DEER hunting in these southern hills until hunting season. −2 Points"
20. "Come back again to the "Prairie State". There is much, much more in store for you. Have a safe journey. 1 Point"

INDIANA SAID STATE CARD

1. "Welcome to the *Hoosier State*! (Indiana) 1 Point"
2. "You arrived just in time for the exciting, enduring, *Indianapolis* 500 *Auto Race.* 5 Points"
3. "Fun time is in store as you travel to *Indiana Dunes National Lakeshore.* 3 Points"
4. "Basketball fever reigns high here! Take in a game today at Indiana University in Bloomington. 4 Points"
5. "Exploring quarries and Stone Mills will be your probing instinct for the day at Bloomington. 2 Points"
6. "Great! You get to go to a *Glass Factory* and see how hand made glass is made at Elwood. 3 Points"
7. "Archeology will be your concern today as you examine Indian Artifacts at *Angel Mounds State Memorial* at Evansville. 4 Points"
8. "History will come alive as you go to *Abraham Lincoln Library and Museum* in Fort Wayne. 3 Points"
9. "You can feel spring in the air as your family drives through *Hoosier National Forrest* and *Buzzard Roost Overlook* captures your interest. 3 Points"
10. "Today at Indianapolis you get to visit *Benjamin Harrison Memorial Home.* (23rd President of the United States). 2 Points"
11. "At Spring Mill State Park at Mitchel you will walk back in time at Spring Mill Village, and visit a frontier trading post with an original Gristmill. 4 Points"
12. "Gather up your family together for the "Belle of Louisville" boat cruise, down Ohio River. (New Albany) 5 Points"

13. "Adventure to *Wyandotte Cave* and explore its many passageways. 3 Points"
14. "Put on your walking shoes as you take many of the trails offered at *Turkey Run State Park.* 4 Points"
15. "Breathtaking, is the only word for your trip today as you visit *Parke County Covered Bridge Festival.* 4 Points"
16. "At Nappanee your family will visit *Amish Acres.* A guided tour awaits you as you view an Amish Farm. 3 Points"
17. "Did you think Santa Claus was at the North Pole! You're excursion today is to visit *Santa Claus Land.* 3 Points"
18. "The striking scenery of the *Brown County Hills* are beckoning your family today. 4 Points"
19. "Sorry—You missed the beauty of the Dogwood and Redbud Drives at Troy and Tell City. Come back next year when they are in full bloom. −2 Points"
20. "Come back again and learn more about our State. Have a safe journey. 1 Point"

MICHIGAN SAID "STATE CARD"

1. "Welcome to the Wolverine State which borders four Great Lakes. (Michigan) 1 point"
2. "You are about to travel across the five Mile suspension bride at *Straits of Mackinac.* 3 points"
3. "You will be touring the Ford Automobile factory in Detroit today. 4 points"
4. "Probe the different constructions made from decayed tree stumps and roots at *Shrine of the Pines* at Baldwin. 3 points"
5. "Attend a Michigan State football game and tour the campus today. 4 points"
6. "Relax by the old lighthouse at Alpena and watch the boats go past. 2 points"
7. "You will be educationally enlightened when you tour the Kellog Company at Battlecreek to see exactly what goes into the Cereal Box you place on your breakfast table. 2 points"
8. "You are delighted as you travel today through the *Grand Traverse Bay Area* to find special buys on bing cherries. 2 points"
9. "Triple treat today at Holland visiting beautiful *Dutch Village, Windmill Island,* and *Netherlands Museum* and get the idea of Dutch life. 6 points"
10. "Your fishermen will be delighted to spend time fishing for Salmon in rivers off of Lake Michigan. 3 points"
11. "*Greenfield Village* at Dearborn will keep everyone intrigued today. 3 points"
12. "Exploring *Henry Ford Museum* and all the shops and exhibits will fascinate your family today. 4 points"
13. "Sightseeing is in store for your family today as you go to *Detroit Civic Center* covering 75 acres. Get on your walking shoes. 2 points"
14. "Your family need time to relax to *Houghton Lake,* one of Michigan's Largest of 11,000 lakes. 2 points"
15. "*Game Haven* will give you a new diversion examining many varieties of animal exhibits. 3 points"
16. "Your family will investigate the five miles of dunes in *Pictural Rock National Lakeshore* in a dunebuggy. 2 points"
17. ""Retreat to *Meadow Brook Hall,* a 100 room mansion in Rochester. 2 points"
18. "Backpacking will provide a get away today through the wilderness in *Isle Royale National Park.* 3 points"
19. "You will be in awe at all the *Bronner's Christmas decorations* display at Frankemmuth. 2 points"
20. "Come back soon to our great state! You only scratched the surface. 1 point"

OHIO SAID "STATE CARD"

1. "You are now entering the Buckeye State. (Ohio) 1 point"
2. "Your family today will be intriqued by *Stan Hywett Hall Gardens* in Akron. It has 14th Century Furnishings. 2 points"
3. "The child in all of us is merging as you join your family to *Kings Island* for a day to discover the six theme areas. 3 points"
4. "The Marina Life at *Sea World* will amuse you today at Aurora. 3 points"
5. "At Kingwood Center in Mansfield, will delight your "Green Thumb" and love for all living plants and flowers. 2 points"
6. "Past, present, and future air travel will be viewed today at the *U.S. Air Force Museum* at Wright Patterson Airforce Base in Dayton. 4 points"
7. "Your itinerary today will take yo to the *President Harding Home and Museum* at Marion. 3 points"
8. "At Bath you are going to Hale Farm and Village where you will see many of the 1826 Crafts Demonstrated. 3 points"
9. "At Akron the *All-American Soap Derby* will hold your future engineers attention today. 2 points"
10. "Your whim today is to take in the *Cincinnati Art Museum.* It reviews paintings, sculptures, etc. through 18th–19th century. 3 points"
11. "At Akron today you will go to *Railways of America.* Your "train buffs" will enjoy the collection of model trains. 3 points"
12. "How did the pioneer settlers live prior to the civil war? You will find out as your family goes to *Campus Martius Memorial Museum* today at Marietta. 2 points"
13. "Your baseball lovers will see Cincinnati Reds at the *Riverfront Stadium* today. 4 points"
14. "Your future astranauts will love to know what it's like to be in space when they visit Astro-Theatre at *Neil Armstrong Air and Space Museum* at Waysakoneta. 3 points"
15. "Lake Erie beckons you to swim on this Hot, Hot day. 3 points"
16. "So sorry! You just missed the *Butter Churn Festival* held in Burton this June. −2 points"
17. "At Toledo you will go to the Toledo Zoological Park. Have fun! 2 points"
18. "The family is tired and wants to take in a Harness race today. 3 points"
19. "Did you ever wonder how a company makes their products? Well today you get to go to *Procter and Gamble* at Cincinnati and find out. 3 points"
20. "Trust you had a good stay in Ohio. Come back soon! 1 points"

KENTUCKY SAID "STATE CARD"

1. "Welcome to the Bluegrass State. (Kentucky) 1 point"
2. "Today your family will relive pioneer life as you visit the rebuilt *Fort Harrod* (established in 1774) at Harrodsburg. 3 points"

3. "At Shakertown at Pleasant Hill, your family will enjoy delicious Shaker food and see the Shaker's furniture designs and architecture at the restored colony. 3 points"
4. "What fun! At Louisville your family will ride the *Belle of Louisville* (a river sternwheeler). 4 points"
5. "Your family will go to *Mammoth Cave* and explore the Caverns. 5 points"
6. "You are about to take a chair lift ride to the top of Natural Bridge at *Natural Bridge State Resort Park* near Slade. 3 points"
7. "At Lexington today your family will visit "*Ashland*", Hency Clay estate (21 room mansion). 3 points"
8. "As you drive today you will enjoy the many miles of board fences, beautiful horses, and white columned esstates. 2 points"
9. "You will tour today *Calumet,* one of the horse farms near Lexington. 3 points"
10. "Your point of interest today will be at Churchill Downs and tour *The Kentucky Derby Museum.* 3 points"
11. "At Louisville your family's learning experience will be seeing pottery made as your tour *Hadley Pottery.* 2 points"
12. "You will examine the *Kentucky Railway Museum* at Louisville. 2 points"
13. "At Beria your family will appreciate all the traditional Appalachian Crafts displayed at *Berean's Appalachian Museum.* 2 points"
14. "You will have an exciting cruise down the Green River at Mammoth Cave National Park. 3 points"
15. "Your bridge to the past will be your visit to *Abraham Lincoln Birthplace National Historic Site* at Hodgenville. 4 points"
16. "*At Land Between the Lakes* will give your plenty of family togetherness as you drive and camp between Kentucky Lake and Lake Barkley. 3 points"
17. "At Williamsburg the child in all of us will love to visit *Tombstone Junction* (a reconstructed Western Town). 2 points"
18. "You will visit the mansion *Federal Hill* at Bardstown. This is the setting which inspired Stephen Foster to compose "My Old Kentucky Home". 3 points"
19. "At Bardsville everyone will enjoy "The Stephen Foster Story" drama. 3 points"
20. "I know you enjoyed Kentucky's Southern Hospitality. Come back soon! 1 point"

FIG. V

Map of United States (small version and not meant to be actual size) provides means for a reference in which players can refer to in selecting contiguous said "State Cards" (FIG. IV) in order that players simulated trip can be chosen. See game rules 3, 4, 5.

FIG. VI

SCORESHEET—Meant to have players keep their own scores and mark mode of travel, states traveled, gas-ups, points, points off, etc. See game rules for more information.

FIG. VII

PLAYING MARKER—(plurality of)—so players can mark their positions while playing on said game board. Said "Playing Markers" are plastic (but not limited to) circular piece in form of a tree and plurality of tree colors. For instance red, light green, dark green, gold, etc.

FIG. VIII

CONTAINER for said game (but not limited to) designed similar to a suitcase to appear one is traveling. Said container provides means to enhance appeal for playing said game and for purpose to hold all pieces of said game, and,

FIG. IX

ONE DIE (but not limited to) for players to determine mode of travel, determine spaces moved on said board game units, for determining when to pick up said "NUISANCE CARDS" and said "PLEASURE CARDS" while playing through said "State Cards".

GAME RULES (2 or more players)

1. Before game is in progress, each player rolls the die (FIG. IX) to determine mode of travel that each player uses during the entire game. They are as follows:
   Roll said die numeral 1=Tent Camping
   Roll said die numeral 2=Fold Down Camper
   Roll said die numeral 3=Truck/Van Camper
   Roll said die numeral 4=Trailer
   Roll said die numeral 5=Large Motor Home
   Roll said die numeral 6=Player can choose one (1–5 above)
   Players record their said "Die Roll" on their Scoresheet. (FIG. VI)
2. Each player gets to start with 20 points to cover gas for their camping trip. Refer to Scoresheet (FIG. VI).
3. A toss of the die will determine which player gets to choose the first "State Card" (FIG. IV). The player that comes closer to numeral 1 on the said "Die Toss" has first choice. In case of tie, those throw again to break tie.
4. Clockwise, players then choose a contiguous said "State Card" to the opponents before him. An example camping trip itinerary as follows: Missouri, Illinois, Indiana, Michigan, Ohio, Kentucky. While players select said contiguous "State Cards", the next player to choose a said "State Card" has at that time an opportunity to challenge the preceding choice of contiguous said "State Card" selection, if he doesn't believe it to be correct. If said challenger is correct, player challenged will have −5 points off of his beginning 20 points and should choose another said "State Card" after looking at United States map (FIG. V) for an adjoining state. If said challenger is wrong, then said challenger takes −5 points off of his beginning 20 points. The said challenger and the said challenged may refer to the United States map (FIG. V), to see which player is correct. When all six said "State Cards" have been selected and placed on game board (FIG. I, A–F), board surface is ready to play.
5. In case of player selects a said "State Card" (FIG. IV) where there isn't any adjoining state left, that has not already been selected, then a state adjoining any of the previous selected states may be chosen.
6. Each player then chooses one colored tree "Playing Marker" (FIG. VII) and places said "Playing Marker" on either of the two starting corners (FIG. I, VI). Player that chose the first said "State Card" (See game rule No. 3) gets to play first. Players play clockwise around the outside of said board with said "Playing Marker", marking location of each player, in accordance with throw of numerical said "Die". Players enter said "State Cards" at designated units (FIG. I, II) and play counter clockwise while playing in said "State Card". Players rotate taking turns clockwise.

7. All said "State Cards" on your camping vacation itinerary (FIG. I, A–F) must be traveled through by each player and checked off on players said "Scoresheet".
8. Play once around board. Player must throw the exact roll of die to end the trip (which will be back to the starting corner (FIG. I,VI) in which said player began. (See game rule No. 14, a)
9. GAS UPS: (FIG. I,I) Green spaces on game board are designated for "GAS UP" for your mode of travel determined in Game Rule No. 1 and recorded on said "Scoresheet" (FIG. VI). Points taken off are as follows:
   Tent Camping: −1 point
   Fold Down Camper: −2 points
   Truck Camper or Van: −3 points
   Trailer: −4 points
   Large Motor Home: −5 points
   Record said "GAS UPS" (FIG. I, I) on said "Scoresheet" as you pass each corner. The green said "GAS UP" units between corners are recorded only if you land on them.
10. NUISANCE CARDS—(FIG. II) "NUISANCE CARDS" are to be read out loud and done as written if applicable. Players pick up said "NUISANCE CARDS" when the numeral 5 appears on roll of said "Die" while playing in said "State Cards" (FIG. IV), or when players land on pink units around said board (FIG. I, IV). Record points off on said "Scoresheet".
11. PLEASURE CARDS—(FIG. III) "PLEASURE CARDS" are read out loud and points added on said "Scoresheet" if applicable. Players pick up a said "PLEASURE CARD" when the numeral 6 appears on throw of said "Die" while playing in said "State Cards", or when player lands on a yellow unit (FIG. I, V) around said board.
12. Lavender units (FIG. I, III)Players lose a turn when landing on these units.
13. White Units (FIG. I, II) Enter said "State Cards" at arrows and move around said "State Card" counter clockwise.
14. TO FINISH GAME:
    a. First one completing trip with exact roll of said "Die" receives an extra 30 points. Remaining players may go out without exact roll of said "die".
    b. Each player must "GAS UP" (see rule No. 9) one last time when completing trip.
    c. Each player completes trip and tallys up his said "Scoresheet".
    d. One with the most points wins the game.

I claim:

1. A game comprising:

A main playing board, a plurality of state cards, one of said state cards to be selected by each of two or more players, a plurality of said state cards being placeable on an area of said playing board, each of the state cards having a travel path thereon with a succession of marked significant points of interest, a primary travel path being provided on the said main playing board completely surrounding the said area on which said state cards are placeable, the said primary travel path on the said main playing board having places of direct access for entrance to and exit from the travel paths on the state cards, the said primary travel path being divided into a plurality of marked sections, a playing marker for each player, a die to be shaken by each player is succession for the number of spaces to be moved by the markers along said primary travel path and state cards paths, this game being designed for means of recreation, and teaching players of different points of interest and provide variation in the game of chance.

2. A game as set forth in claim 1 further comprising a stack of cards provided in position face down to be drawn in succession from the top, giving the players plus points, a second stack of cards provided in position face down to be drawn in succession from the top, giving the player minus points, some of said sections on the primary travel path being marked to determine plus or minus points, other sections being marked as gas-ups, other sections marked with criteria of travel for means to train players in modes of travel, with pros and cons of each mode, other sections in said primary travel path being marked as entrances to the state cards, the said travel path on said state cards being marked in plurality of sections designating significant areas of interest with variable number of points being awarded to the player when said playing marker lands on said section, this game being designed for means of recreation, and for teaching techniques of travel, relative geographic locations of different political units, acquaint players with different areas of interest and to provide variation in the game of chance involved.

3. A game as set forth in claim 2 in which, said playing markers are considered as a vehicle with type of equipment determined at the start of the game, a die, with numbers thereon representing different modes of travel for means of learning more of the pros and cons of various modes of travel.

* * * * *